United States Patent [19]

Mulholland

[11] 3,986,307

[45] Oct. 19, 1976

[54] BUILDING UNIT CONSTRUCTION

[76] Inventor: Grant C. Mulholland, 1104-23rd Drive SW., Austin, Minn. 55912

[22] Filed: Jan. 2, 1976

[21] Appl. No.: 645,691

Related U.S. Application Data

[63] Continuation-in-part of Ser. No. 494,394, Aug. 5, 1974, abandoned.

[52] U.S. Cl. ..... 52/91; 52/223 R; 52/263

[51] Int. Cl.[2] ..... E04B 7/04

[58] Field of Search ..... 52/90, 91, 223 R, 263, 52/478

[56] References Cited

UNITED STATES PATENTS

| | | | |
|---|---|---|---|
| 1,189,360 | 7/1916 | Guerini | 52/91 X |
| 1,249,031 | 12/1917 | Clark | 52/91 X |
| 1,392,532 | 10/1921 | Simpson | 52/91 |
| 2,690,072 | 9/1954 | Reed | 52/91 X |
| 3,007,284 | 11/1961 | Dorland | 52/223 R |

FOREIGN PATENTS OR APPLICATIONS

| | | | |
|---|---|---|---|
| 976,285 | 10/1950 | France | 52/90 |
| 958,194 | 9/1949 | France | 52/90 |
| 1,011,998 | 4/1952 | France | 52/90 |
| 722,649 | 1/1955 | United Kingdom | 52/90 |

*Primary Examiner*—Alfred C. Perham
*Attorney, Agent, or Firm*—Schroeder, Siegfried, Ryan & Vidas

[57] ABSTRACT

An all concrete building construction characterized by a roof comprised of a plurality of spaced upright concrete truss panels having stepped upper edges which support overlapping concrete roof panels and foot elements which bear upon supporting concrete pillars and support each truss panel and also support concrete ceiling slabs which extend between the truss panels. In one form, the foot elements extend laterally to meet and form the ceiling in lieu of the concrete slabs.

6 Claims, 10 Drawing Figures

BUILDING UNIT CONSTRUCTION

This is a continuation of application Ser. No. 494,394, filed Aug. 5, 1974, now abandoned.

It is a general object of my invention to provide a novel and improved building construction unit. More particularly, it is an object of the invention to provide a novel and improved roof construction and method of making same.

Another object is to provide a novel and improved roof construction which can be manufactured substantially entirely of concrete without undue weight, materials cost, and labor.

Another object is to provide a novel and improved roof structure which is simple in construction and erection, is relatively inexpensive, and is substantially lighter in weight.

Another object is to provide a novel and improved building unit construction which enables a contractor to erect a house with a minimum of labor and within 1-2 days time at a relatively low cost from prefabricated parts.

These and other objects and advantages of the invention will more fully appear from the following description, made in connection with the accompanying drawings, wherein like reference characters refer to the same or similar parts throughout the several views, and in which.

Figure 1:
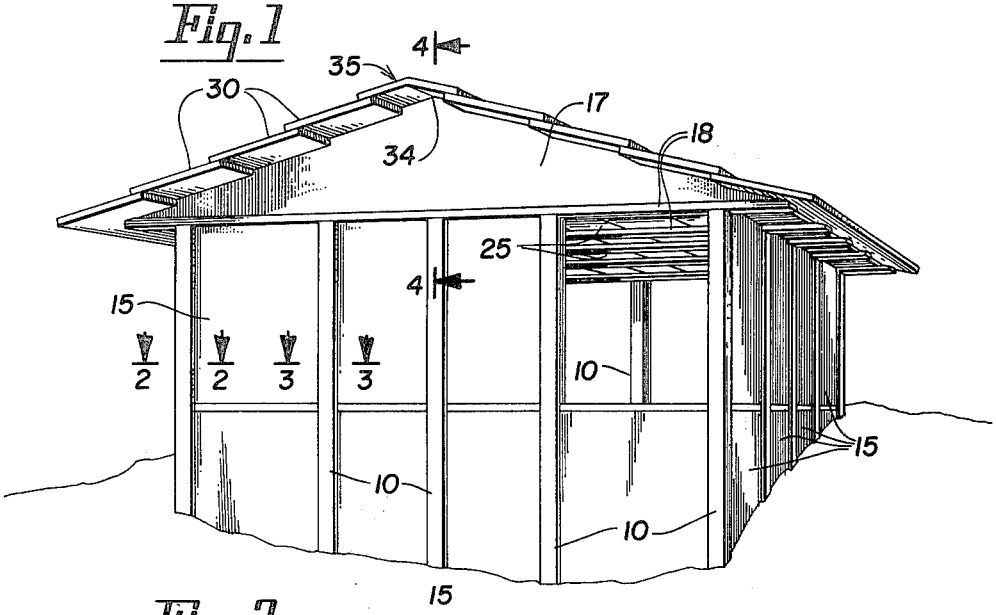
FIG. 1 is a perspective view of a building unit structure which is constructed in accordance with my invention.
Figure 2:
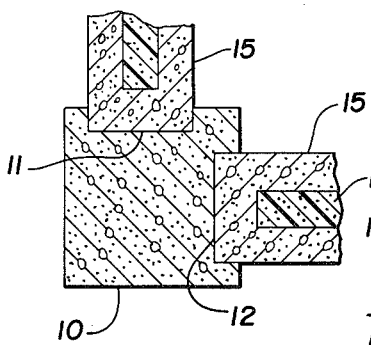
FIG. 2 is a fragmentary, vertical sectional view on an enlarged scale taken along line 2—2 of FIG. 1.
Figure 3:
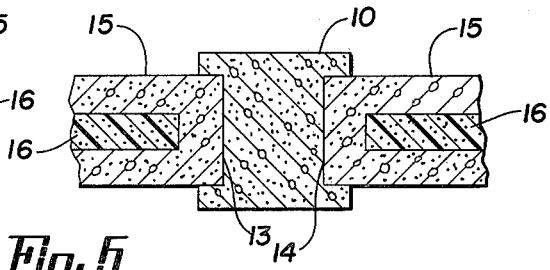
FIG. 3 is a fragmentary, horizontal sectional view on an enlarged scale taken along line 3—3 of FIG. 1.

As shown in FIG. 1, my novel building construction unit includes a plurality of vertical pillars 10 which are mounted in upright position upon footings (not shown) in positions relative to each other so as to cooperatively define an area therebetween. As best shown in FIG. 2, the corner pillars 10 are provided with recesses 11 and 12 in two of its adjacent sides. As best shown in FIG. 3, the intermediate pillars are provided with recesses such as 13 and 14 in opposite sides. Received within these recesses, 11–14 inclusive, are concrete wall panels 15, each of which has an insulated core 16 extending therewithin throughout the major portion of its interior.

Figure 5:
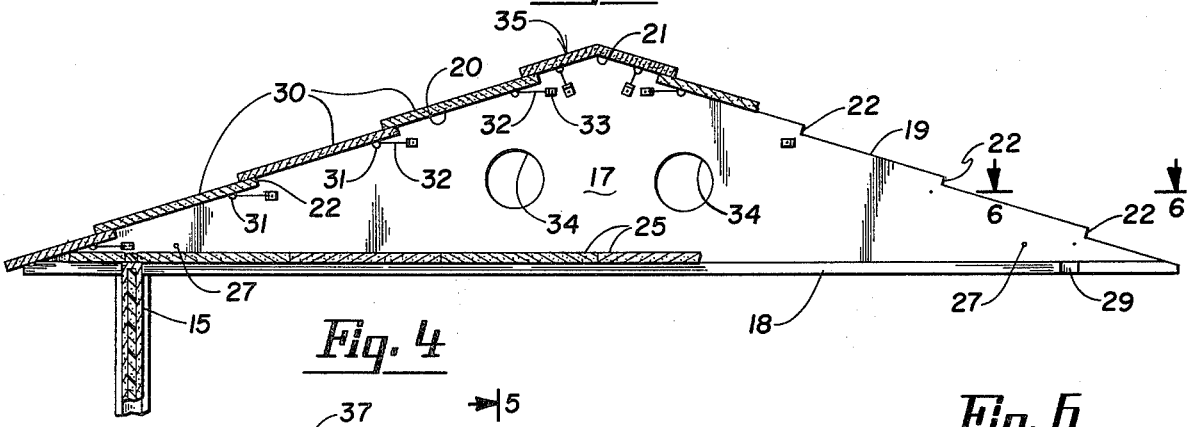
FIG. 5 is a vertical sectional view taken along line 5—5 of FIG. 4.

As indicated above, my invention is comprised of a unique, substantially all-concrete roof construction. It is comprised of a plurality of truss panels 17 which are mounted in upright position upon the upper ends of a pair, or more, of the pillars 10. This can best be seen in FIG. 4. As shown in FIG. 1, the end panels are supported by two corner pillars and on a plurality of additional pillars which are spaced intermediate these corners. Each of these panels is constructed of prestressed concrete and are generally of congruent triangular shape. As shown in FIG. 5, each of these panels 17 has a base 18 which extends horizontally and a pair of corresponding legs 19 and 20 which extend at angles to the base and intersect at an apex as indicated by the numeral 21.

Figure 4:
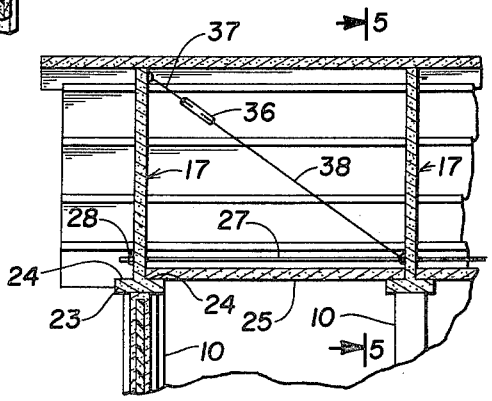
FIG. 4 is a partial vertical sectional view taken along line 4—4 of FIG. 1.
Figure 6:
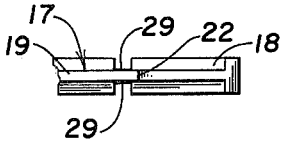
FIG. 6 is a partial plan view taken along lines 6—6 of FIG. 5.

The upper edges of each of the panels 17 are provided with a plurality of spaced steps 22 which are designed to receive roof panels as hereinafter described. Each of the truss panels 17 is also provided with a foot member 23 which extends the length of the base of the truss panel and extends laterally outwardly a short distance, as best shown in FIG. 4 to provide shoulder elements 24 at each side thereof. These shoulder elements 24 support a plurality of concrete ceiling slabs 25 which are constructed of such length so as to abut against the adjacent truss panels 17 when they are placed therebetween so as to rest upon the shoulders 24 to constitute a ceiling for the room disposed therebelow.

Figure 9:
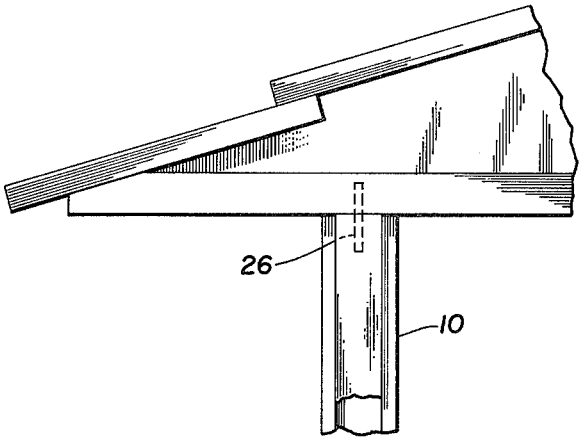
FIG. 9 is a fragmentary end elevational view of my roof construction on an enlarged scale.

The end panels 17 are each secured to the corner pillar 10, as best shown in FIG. 9, by means of a metal rod or pin connector 26 which is received within a recess formed in the upper end of the pillar 10 at the time of manufacture of the latter, and extends upwardly into a similar recess formed in the underside of the foot member 23, likewise at its time of manufacture. In addition, a rod 27 is disposed at each end of the truss panel 17 and extends transversely therethrough to and through the adjacent truss panel and is secured at each of its ends with a nut 28 for the purpose of ensuring that none of the truss panels may spread sufficiently to permit a ceiling slab 25 to drop downwardly therebetween.

Figure 10:
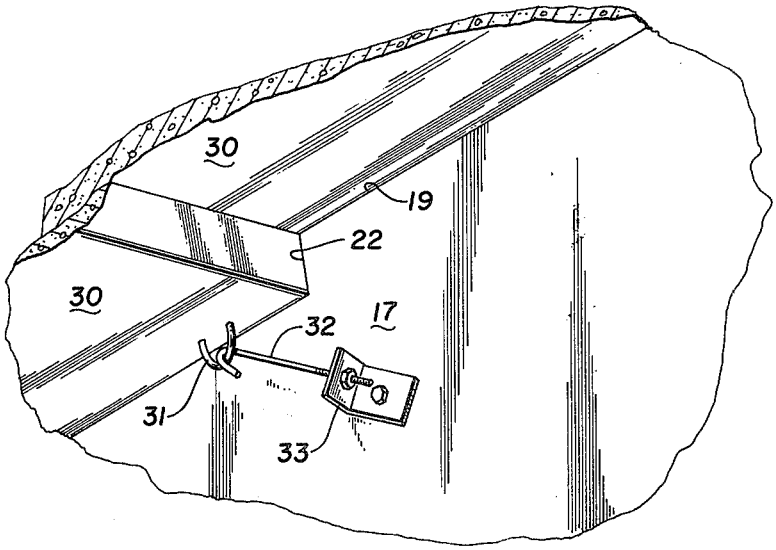
FIG. 10 is a detailed perspective view on an enlarged scale showing the means by which the roof panels and roof cap are secured to the individual truss panel.

Extending transversely of the roof panel 17 and secured along the stepped upper edges thereof to each such panel are a plurality of roof panels 30. As can best be seen in FIG. 5, the roof panels are applied to the stepped surfaces so that the upper edge of each panel abuts against one of the steps 22 of the truss panel. In assembly, the roof panels are applied to the lower steps first and thereafter, each additional panel is applied to the next step moving upwardly toward the apex with the lower edge portions of each successive roof panel overlapping the upper edge portions of the roof panel applied immediately preceding therebelow. This can best be seen by reference to FIG. 5. It will be seen that each roof panel is rectangular in cross-section and devoid of any peripheral outwardly extending framing rib such as is utilized in French Pat. No. 976,285. Thus, each roof panel 30 rests flush upon the stepped surface of the truss panel 17 and the lower edge portions of each such panel bears flush against the upper edge portion of the immediately lower panel in ideal weather sealing conditions. Each of the panels 30 is provided with a metal lift loop 31 which is embedded in the prestressed concrete roof panel at its time of manufacture. A rod, 32 having a hook at one end which engages the loop 31, extends to an anchor plate 33 carried by and secured to the panel 17 by means of a bolt which extends through the truss panel. The rod 32 extends through an opening in the anchor plate 33 and is secured thereto and tightened by means of a nut as best shown in FIG. 10. Each truss panel 17 is provided with such anchor plates and each roof panel is provided with such lift loops in proper relative positions to fascilitate the securing of the roof panels 30 to the truss panel 17 in this manner.

The apexes of the plurality of truss panel 17 together define a ridge line indicated by the numerals 34 in FIG. 1. A roof cap member 35 which is chevron-shaped when considered cross-sectionally, is likewise formed of prestressed concrete and extends the length of the building construction from one end panel to the other. This roof panel is provided with a metal mesh core and in practice is manufactured flat and then is cut at one side slightly so as not to penetrate into the metal mesh core, then shaped to the chevron-shape as shown in FIG. 5. The roof cap 35 is then secured to the individual truss panel 17 in the same manner in which the roof panels are secured thereto as is shown in FIG. 5. After the roof cap has been applied and secured, the slight opening formed by the cut referred to above is filled with caulking material.

As best shown in FIG. 4, a turn-buckle arrangement is provided to anchor the upper portions of the end truss panel 17 to the lower portions of the adjacent truss panel. The turn buckle 36 is threaded upon two rods 37 and 38, each of which is properly anchored to loops similar to the lifting loops 31. By adjusting the turn buckle 36, tension can be applied to the rods 37 and 38 to ensure that the upper portions on the end panels will not swing outwardly.

As best shown in FIG. 5, the underside of the foot members are provided with recesses 29 into which the wall panels of the building construction unit extend. This provides added rigidity and ensures against relative movement between the side walls, the truss panels, and the pillars.

Figure 7:
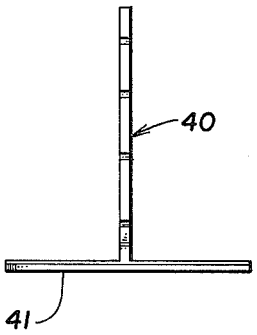
FIG. 7 is an end elevation of a truss panel of the present invention in a modified form.

FIG. 7 shows a modified form of my invention in which the truss panels 40 have foot members such as 41, which extend laterally a substantial distance so as to obviate the need for the shoulder elements and the ceiling slabs 25. In other words, the foot element itself becomes the ceiling slab with the laterally extending portions of one of the truss panels 40 meeting the laterally extending portion of the adjacent truss panel to cooperatively form the ceiling. Simple caulking of the joints completes the construction. This obviates the need for separate ceiling slabs, if such is desired.

Figure 8:
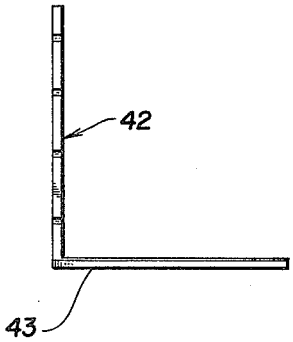
FIG. 8 is an end elevational view of a third form of truss panel which may be utilized in my invention.

FIG. 8 shows a third form of truss panel included in my invention. In this instance, the foot element 43 extends laterally from one side only for a substantial distance and abuts against the vertical portion of the adjacent truss panel, thereby providing the entire ceiling structure between two adjacent truss panels. Again, simple caulking completes the construction operation and the need for separate ceiling slabs has been obviated.

In erecting a building construction in accordance with my invention, the entire operation can be completed with a minimum amount of time and labor. Once the pillars have been erected, the truss panels can be lifted into position with a crane and secured in an upright position thereon. Then the ceiling slabs are likewise lifted into position with the crane so that the interior of the building is completely defined. Thereafter, the panels 30 are applied in turn, commencing at the lower portion of the truss panel and superimposing each successive roof panel in overlapped relation to the preceding lower panel. The panels may be secured by men who are able to walk upon the ceiling in the interior and to move between the panels through manhole openings 44 provided therein as shown in FIG. 5. When all of the roof panels have been applied, the roof cap 35 is lifted into position and secured thereat. Thereafter, after the rod 27 has been secured and the turn buckle 36 had been applied, all that remains to complete the operation is the simple caulking operations referred to above and those which are required to complete the weather seal at the various joints where the side walls extend into the pillars and foot members, etc.

It will be readily seen that my invention provides an unusually simple and relatively inexpensive building construction. The ceiling slabs can be of mere reinforced concrete and can be only 2½″ thick. The truss panels 17 are preferably approximately 3″ thick, except at the foot member 18 where they are approximately 10″ thick. This is in sharp contrast to a flat slab ceiling which would otherwise be required and would necessarily be approximately 6″ thick, or thicker, in order to have the required strength. Thus it can be seen that my construction is substantially lighter and less expensive and, in addition, it is simple to manufacture and erect. Most importantly, there is a very great reduction in the amount of labor required in order to manufacture and erect a building construction in accordance with my invention.

It will, of course, be understood that various changes may be made in the form, details, arrangement and proportions of the parts without departing from the scope of the invention which consists of the matter shown and described herein and set forth in the appended claims.

I claim:

1. In a roof construction unit, a. a plurality of generally congruent triangularly shaped concrete truss panels spaced horizontally from and extending parallel to each other and each having a horizontal base and corresponding legs extending at angles to its base and intersecting at an apex, b. at least two of said truss panels having stepped edge surfaces extending along the legs of the triangle adapting the same to receive and support transversely extending roof panels thereupon, c. a foot member carried by each of said truss panels and extending along and outwardly of the base edge thereof, said foot member being adapted to be received in supported relation upon the upper end of supporting pillars, each of said truss panels being adapted to be secured in upright position to the upper ends of such pillars, d. a plurality of concrete roof panels extending transversely of more than two of said truss panels in supported relation upon their stepped surfaces with the upper edge portion of said roof panels being positioned immediately adjacent and below a line of steps of said truss panels and the lower edge portion of each of said roof panels extending downwardly in overlapping relation to the upper edge portions of the roof panel disposed immediately therebelow upon said truss panels, and e. cooperative securing means carried by said truss panels and said roof panels and fixedly securing the same to each other in said relative positions.

2. In a roof construction unit, a. a plurality of upright generally congruent triangularly shaped concrete roof truss panels exceeding two in number and being of equal size and spaced horizontally from and extending parallel to each other and each having a horizontal base and corresponding legs extending at angles to its base and intersecting at an apex, b. at least two of said truss panels having stepped edge surfaces extending along the legs of the triangle adapting the same to receive and support transversely extending roof panels thereupon, c. the upper surface of each step of said truss panels being planar, d. a foot member carried by each of said truss panels and extending along and outwardly of the base edge thereof, said foot member being adapted to be received in supported relation upon the upper end of supporting pillars, each of said truss panels being adapted to be secured in upright position to the upper ends of such pillars, e. a plurality of concrete roof panels each extending transversely across each of said plurality of truss panels in supported relation upon their stepped surfaces with the upper edge portion of said roof panels being positioned immediately adjacent and below a line of steps of said truss panels and the lower edge portion of each of said roof panels extending downwardly in overlapping relation to the upper edge portions of the roof panel disposed immediately therebelow upon said truss panels, f. each of said roof panels being rectangular in cross-sectional shape, and g. cooperative tie means carried by said truss panels and said roof panels and fixedly securing the same to each other in said relative positions.

3. The structure defined in claim 2 wherein the thickness of each of said roof panels is equal to the height of each of said steps in said truss panels.

4. The structure defined in claim 2 wherein each of said roof panels is devoid of any peripheral outwardly extending framing rib.

5. The structure in claim 2, f. a shoulder element carried by each of said foot members and extending outwardly therefrom toward each adjacent truss panel, and g. separate concrete ceiling slabs supported by said shoulder elements and extending between said adjacent truss panels and constituting, in cooperation with the foot members thereof, a ceiling beneath the roof panels supported by said truss panels.

6. The structure defined in claim 2, f. an elongated concrete roof cap member of generally chevron shape in cross-section superimposed and extending longitudinally along the ridgeline defined by the apex of said truss panels with each of the lower edge portions of said roof cap member overlapping the upper edge portions of the roof panel disposed immediately therebelow upon said truss panels, and g. cooperative securing means carried by said truss panels and said roof cap member and fixedly securing the same to each other in said relative positions.

* * * * *